United States Patent [19]

Gabrielli

[11] 4,395,801

[45] Aug. 2, 1983

[54] SPORTS BOOT FASTENER

[75] Inventor: Andrea Gabrielli, Predazzo, Italy

[73] Assignee: Lange International S.A., Fribourg, Switzerland

[21] Appl. No.: 266,892

[22] Filed: May 26, 1981

[30] Foreign Application Priority Data

Sep. 1, 1980 [CH] Switzerland ..... 6559/80

[51] Int. Cl.[3] ..... A43C 11/00

[52] U.S. Cl. ..... 24/70 SK; 24/71 SK; 24/50

[58] Field of Search ..... 24/68 SK, 69 SK, 70 SK, 24/71 SK, 69 R, 69 ST, 69 TS, 206 A, 248 E, 17 A, 70 ST, 71 R, 170, 169, 191, 201 C, 19, 272, 273, 70 R, 69 AT, 302; 36/50, 97, 117, 120, 121

[56] References Cited

U.S. PATENT DOCUMENTS 3,295,177 1/1967 Brückl ..... 24/272

3,654,670 4/1972 Baso ..... 36/117

4,051,611 10/1977 Chalmers ..... 24/68 SK

FOREIGN PATENT DOCUMENTS 1330828 5/1963 France .

1568081 4/1969 France .

2062082 6/1971 France .

2411584 7/1979 France .

595070 1/1978 Switzerland .

*Primary Examiner*—Gene Mancene

*Assistant Examiner*—John Weiss

*Attorney, Agent, or Firm*—Brumbaugh, Graves, Donohue & Raymond

[57] ABSTRACT

This fastener notably for sports boot comprises an indented strap secured to one portion of the boot and a rack associated with the strap for nipping the latter with the assistance of a yoke. The rack is engageable by a transverse element carried by one end of an arm pivoted to a tightening lever mounted on the other portion of the boot.

5 Claims, 6 Drawing Figures

SPORTS BOOT FASTENER

BACKGROUND OF THE INVENTION

The present invention relates to a sports boot fastener, notably for ski boots, of the type comprising a toothed anchoring rack adapted to be fastened to a first portion of the boot and a tightening lever pivoted to a yoke adapted to be secured to another portion of the boot which is to be firmly assembled with the first portion, said yoke being provided with a hooking member matching said anchoring rack and adapted releasably to engage this rack.

THE PRIOR ART

A device of this type is disclosed in the Swiss Pat. No. 615,811, which shows an anchoring rack secured directly to one of the boot portions by means of one or two rivets. The tightening lever is connected to a hooking buckle by means of a threaded rod and a nut-forming buckle support for permitting the fine adjustment of the fastener closing force. However, the range of permissible adjustment of the fastener closing force is subordinate essentially by the number of teeth of the rack. Under these conditions, if one wished to increase this adjustment range, one would be compelled to increase the rack length and also the buckle length, but this would not be feasible in actual practice for lack of space, not to mention the undesired increment in the boot weight. On the other hand, the fine adjustment of the fastener by means of a threaded rod is attended by several inconveniences; thus, if the user unscrews almost completely the buckle support so that the rod is retained only by one or two threads, the support is most likely to be stripped off when an excessive tension is exerted thereon; furthermore, the user runs the risk of unscrewing completely the buckle support, or loosing it and in any case experiencing have some difficulties when attempting to refit this support in place.

SUMMARY OF THE INVENTION

This invention is directed to avoid these various inconveniences by providing a sports boot fastener in which the anchoring rack is connected to the first boot portion by means of a strap having an indented or toothed inner surface, this rack being pivoted to a yoke provided with at least one tooth adapted to engage at least one notch of the indented face of the strap, said anchoring rack further comprising about its pivot axis a portion eccentric in relation to this axis and adapted to nip said strap between this eccentric portion and the yoke, when the anchoring rack is moved to its fastener closing position, i.e. towards the strap, a gap being left between the tightening lever and its supporting yoke to permit the passage of said indented strap therethrough.

The device of this invention is attended by several advantageous features with respect to the prior art: in fact, there is no limit to the length of the indented strap, which determines the total length of the permissible fastener adjustment range. Consequently, the anchoring rack may be extremely short, and with a short rack it is possible to use a likewise shorter hooking member, buckle or the like. Moreover, the device is free of any threaded or tapped component elements, which are expensive, difficult to handle and prone to jam. The rack movement from one point to another of the indented strap may take place very rapidly, since it is only necessary to raise the rack, cause same to slide along the indented strap and fold it down at the selected position. The movable parts of the device may be of simple, sturdy construction. The overall dimensions are relatively small since the indented strap is inserted through the yokes of the two portions of the device.

In a preferred form of embodiment of the present invention the rack comprises a longitudinal median slot and the hooking member pivoted to the tightening lever consists of an intermediate arm engaging the rack slot and comprises a cross member for releasably engaging the rack teeth. This construction is particularly sturdy and compact.

Two exemplary forms of embodiment of the invention will now be described by way of example with reference to the accompanying drawings.

THE DRAWINGS

DESCRIPTION OF THE PREFERRED EMBODIMENT

The indented strap 1 consists of a suitable plastic material having a relatively high resistance to abrasion. This strap 1 is manufactured by injection molding, and its lower surface has transverse notches 2 formed therein.

Figure 1:
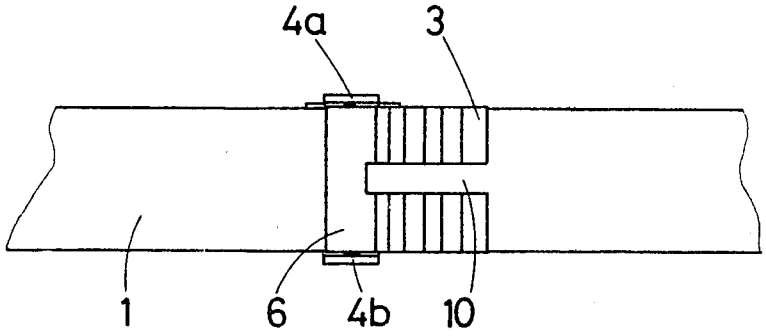
FIG. 1 is a plane view of one portion of the indented strap associated with the anchoring rack.
Figure 2:
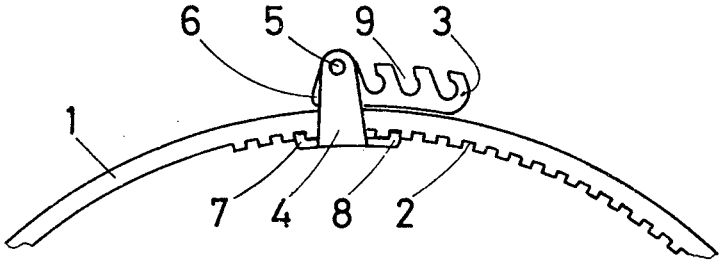
FIG. 2 is a side elevational view of the same portion of the indented strap portion with the anchoring rack.
Figure 3:
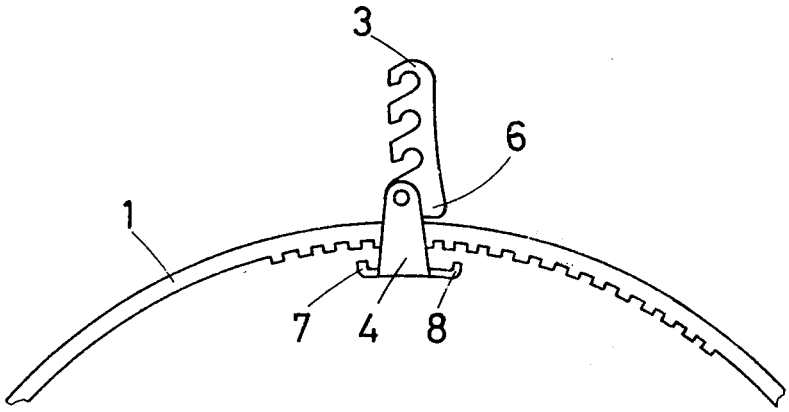
FIG. 3 is another side elevational view showing the same component elements, showing the rack in its raised position.

The anchoring rack 3 is pivotally mounted in a yoke 4 about a transverse pivot pin 5 having its ends riveted externally of the yoke wings 4*a* and 4*b*. About this pin 5 the rack 3 is formed with an eccentric portion 6. The base interconnecting the yoke wings 4*a* and 4*b* comprises two edges 7,8 bent upwards like these wings to form a pair of teeth engageable into spaced notches 2 of the indented strap 1. Furthermore, the anchoring rack 3 has formed therein three oblique notches 9 and a longitudinal median slot 10 extending substantially from one end to the portion thereof receiving the pivot pin 5 therethrough. When the rack 3 is raised (FIG. 3) its eccentric portion 6 moves away from the indented strap 1, so that the yoke 4 can slide freely along the strap. When the rack 3 is folded back towards strap 1 (FIG. 2) its eccentric portion 6 acts as a nipper and wedges or clamps the indented strap 1 between the rack and the teeth 7 and 8 of yoke 4. Thus, if the rack is pulled in a direction parallel to the indented strap this wedging action is unaffected.

Figure 4:
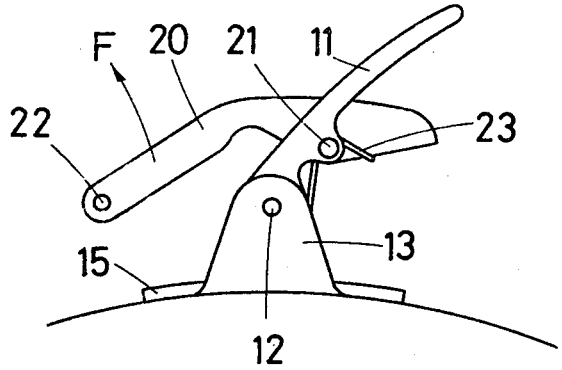
FIG. 4 is a side elevational view showing the tightening device in its open position.
Figure 5:
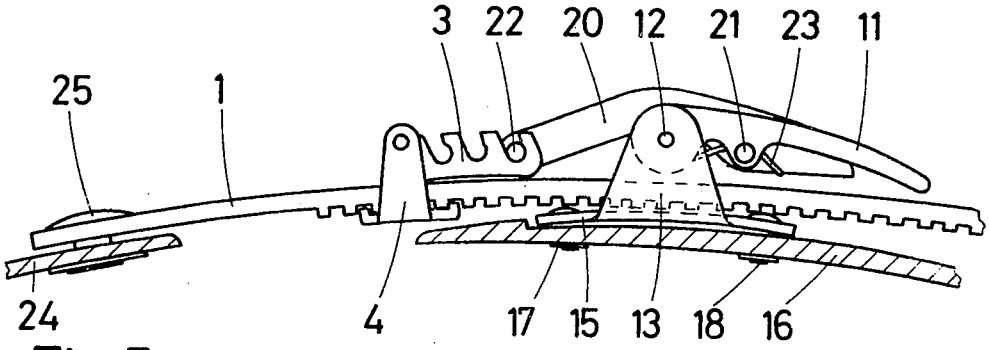
FIG. 5 is a side elevational view showing the complete fastener in its closed position.

The tightening device comprises a lever 11 fulcrumed by means of a pivot pin 12 between the spaced wings 13 and 14 of another yoke having its base plate 15 secured to one portion 16 of the boot (not shown) by means of a pair of rivets 17 and 18 (FIG. 5). A slot 19 aligned with the slot 10 of anchoring rack 3 is formed in lever 11 and engaged by a hooking arm 20 pivoted to said lever 11 about a pivot pin 21. The end of arm 20 carries a transverse rod 22 adapted releasably to engage one of the notches of rack 3. The pivot pin 21 is surrounded by a calliper spring 23 exerting an elastic pressure on the one hand against the hub of lever 11 and on the other hand against an extension of arm 20, whereby this spring 23 constantly urges the arm 20 to the position in which the latter engages the pivot pin 12. In the position illustrated in FIG. 4 the arm 20 is thus assumed to be lifted by a force F. The spring 23 is relatively weak, so that the arm 20 can be raised very easily.

Figure 6:
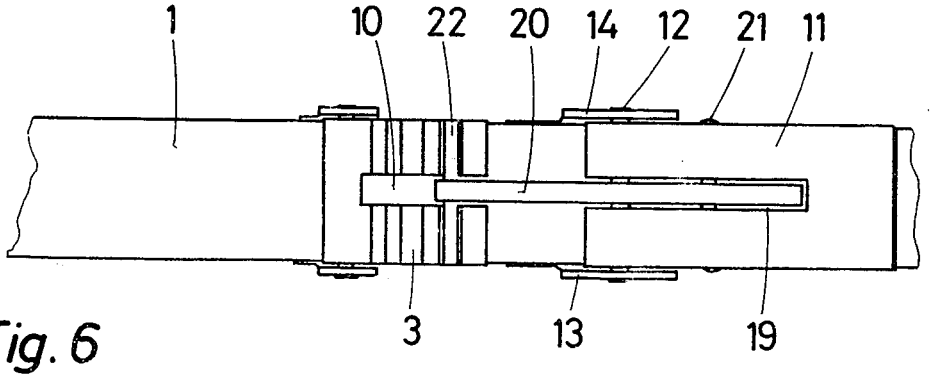
FIG. 6 is a plane view showing the fastener of FIG. 6 in the same position.

FIG. 5 also illustrates the fixing of one end of strap 1 to the second portion 24 of the boot by means of a rivet 25. This Figure further shows that a sufficient gap is provided between the bottom or base of yoke 15 and the hub of lever 11 to permit the passage of the indented strap 1. Since the folding-down movement of arm 20 is limited by the presence of pivot pin 12, it is also possible to easily insert at any time the free end of strap 1 between the end of arm 20 and the base 15 of the tightener yoke. In the closed position shown in FIGS. 5 and 6 the arm 20 engages the slot 10 of rack 3, so that the height of the device is further decreased.

However, it would not constitute a departure from the basic principles of the present invention to substitute a rectangular buckle or a plate having a hook-forming curved end for the arm 20 constituting the hooking member proper.

The use of an indented strap is attended by several advantages: it permits on the one hand, independently of the distance between the two boot portions to be assembled, of positioning the hooking rack in close vicinity of the tightening device, and on the other hand of adapting the length of the indented strap to the specific application contemplated, without inasmuch reducing the intrinsic quality of the fastener. This last-mentioned feature is particularly valuable in the case of ski boots which require a uniform tightening force. To this end, the indented strap may extend from the boot sole and surround the upper portion of the foot.

The use of the fastener of this invention is particularly convenient. The user can modify in a trice the fine adjustment, i.e. the rack position, under any circumstance and without using any tool. It is only necessary to raise the rack and cause same to slide along the indented strap.

What is claimed is:

1. A sports boot fastener comprising:

anchoring means having a base and a rack, for engaging a hooking member, pivotably mounted to said base;

means for connecting said anchoring means to a first portion of the boot; and a tightening lever pivotably coupled to another portion of the boot which is to be fastened to the first portion; said lever being provided with a hooking member adapted to releasably engage said rack;

wherein said base and rack are adapted to receive the connecting means therebetween; wherein said rack has an eccentric portion; wherein said anchoring means and said connecting means are provided with cooperating positive locking means therebetween for securing said anchoring means at a selected one of a plurality of spaced locations relative to said connecting means; and wherein said rack is pivotable to move said eccentric portion away from said base to a release position, in which said positive locking means are disengaged and said connecting means and said anchoring means are relatively displaceable, and toward said base to a locking position, in which said eccentric portion causes said positive locking means to engage.

2. The fastener of claim 1, wherein said connecting means comprises an elongated strap, wherein said base comprises a yoke, wherein said positive locking means comprises a plurality of notches on said strap and at least one tooth on said yoke engageable in said notches, said eccentric portion and said tooth being arranged to receive said strap therebetween, and wherein said rack, in said locking position, lies substantially parallel to said strap.

3. The fastener of claim 2 wherein said rack has a median longitudinal slot formed therein and a plurality of second notches extending from said slot; wherein said hooking member comprises an arm pivoted to said lever and provided at one end with a cross rod engageable in a selected second notch, wherein said lever is moveable between a lever release position and a lever locking position; and spring means mounted on said tightening lever for urging said cross rod into engagement with said selected notch in said lever locking position.

4. The fastener of claim 2, wherein said rack comprises a plurality of second notches, and wherein said hooking member comprises an arm pivoted to said tightening lever and formed with a bent end portion engageable in a selected one of said second notches.

5. The fastener of claim 2, wherein said tightening lever is pivotably mounted in a second yoke, and wherein said lever and a bottom portion of said second yoke define a gap adapted to receive said strap.

* * * * *